US007134610B2

(12) United States Patent
Wulteputte

(10) Patent No.: US 7,134,610 B2
(45) Date of Patent: Nov. 14, 2006

(54) METHOD AND APPARATUS FOR MONITORING SYSTEM INTEGRITY IN GAS CONDITIONING APPLICATIONS

(75) Inventor: Lieven Wulteputte, Melle (BE)

(73) Assignee: Spraying Systems Co., Wheaton, IL (US)

( * ) Notice: Subject to any disclaimer, the term of this patent is extended or adjusted under 35 U.S.C. 154(b) by 117 days.

(21) Appl. No.: 10/603,836

(22) Filed: Jun. 25, 2003

(65) Prior Publication Data

US 2004/0262428 A1 Dec. 30, 2004

(51) Int. Cl.
*A62B 18/00* (2006.01)

(52) U.S. Cl. ..... 239/270; 239/300; 239/310; 239/377; 239/366; 239/341

(58) Field of Classification Search ..... 239/270, 239/300, 310, 311, 337, 366, 341, 377
See application file for complete search history.

(56) References Cited

U.S. PATENT DOCUMENTS 5,193,406 A * 3/1993 Wolf et al. ..... 73/865.9
5,677,500 A * 10/1997 Ackerley et al. ..... 73/865.9
5,881,818 A * 3/1999 Lee et al. ..... 169/15
5,950,441 A * 9/1999 Mahableshwarkar et al. ..... 62/171
6,010,083 A * 1/2000 Roe et al. ..... 239/427.5
6,045,056 A * 4/2000 Tardoni ..... 239/8
6,293,787 B1 9/2001 Reyes ..... 432/14

FOREIGN PATENT DOCUMENTS

| | | |
|---|---|---|
| EP | 1243341 | 9/2002 |
| JP | 2003106878 | 4/2003 |
| WO | WO 03/035269 | 5/2003 |

* cited by examiner

*Primary Examiner*—David A. Scherbel
*Assistant Examiner*—James S. Hogan
(74) *Attorney, Agent, or Firm*—Leydig, Voit & Mayer, Ltd.

(57) ABSTRACT

A control system for monitoring the performance of one or more spray nozzles measures variables such as liquid flow rate and liquid pressure of spray being delivered to the spray nozzles and provides a sensing signal when the difference, at a given liquid pressure, between a calculated liquid flow rate and an actual liquid flow rate exceeds an error.

7 Claims, 2 Drawing Sheets

METHOD AND APPARATUS FOR MONITORING SYSTEM INTEGRITY IN GAS CONDITIONING APPLICATIONS

FIELD OF THE INVENTION

This invention generally relates to spray control systems, and more particularly, to control systems used to monitor spraying conditions and characteristics in industrial gas conditioning applications.

BACKGROUND OF THE INVENTION

Industrial production plants usually include a filtration system, e.g., bag-house and other components, that operates to generate hot or flue gases. Such flue gases must usually be cooled for proper operation of the production plant. In these applications, the flue gases are often passed through various portions of the production plant to provide a cooling effect. In other cases, however, additional cooling and conditioning systems must be utilized to produce the proper temperature. The flue gas is sometimes cooled by injecting an atomized liquid stream into the gas stream, such as through spraying water with very fine droplets into the gas stream. This operates to reduce the temperature of the gas stream.

Various cooling requirements for a production plant of the general type described above are also known in the art. For example, the outlet temperature is typically maintained at a particular temperature level or temperature set-point to permit proper operation of the plant. Inasmuch as the flue gases typically raise the outlet temperature above the set-point value, the spraying system must reduce the outlet temperature to desirable levels. In addition, the liquid spray applied to the flue gases should be completely evaporated within a given distance of travel of the flue gases (dwell distance). That is, all or substantially all of the liquid must be evaporated within a given distance of the location of the spray nozzle or nozzles to avoid undue wetting and wear of the various components of the plant.

For providing a liquid spray, such systems sometimes employ one or more bi-fluid nozzles. The nozzles use compressed air as an energy carrier to atomize a liquid, such as water, into fine droplets. In most systems today, the air pressure used for spray nozzles of this type is kept constant over the operating cooling range. The amount of constant air pressure required is usually calculated based on the maximum allowed droplet size for obtaining total evaporation, a parameter known to those skilled in the are as Dmax (i.e., maximum droplet size), within a given distance at the worst cooling conditions (usually at maximum inlet gas temperature and maximum inlet gas flow rate).

Of course, less liquid spray is required to cool the gas to the desired temperature when the inlet gas flow rate or inlet temperature decreases. Maintenance of a constant air pressure in these circumstances causes the air-flow rate to increase. This results in increased air consumption and in increased compressed air energy cost. For maintaining the cooling requirements of the system, it is often unnecessary to maintain the air pressure constant at lower cooling conditions. Thus, it would be desirable to closely monitor these parameters of the system to enable appropriate detection of deviations in the operating components of the system. In this way, adjustment of certain operating characteristics and/or replacement of worn or malfunctioning components may be effected.

SUMMARY OF THE INVENTION

Accordingly, it is a general object of the invention to overcome the problems in the prior art.

It is a more specific object of the invention to provide method and system for monitoring the nozzle operating conditions in gas conditioning applications.

It is a further object of the invention to provide a method and system for producing a detection signal and/or taking other action when certain operating conditions exceed a maximum allowable error.

This invention monitors the operating conditions of spray nozzles of the type used in gas cooling applications. In particular, these nozzles receive both a pressurized air supply as well as a liquid. The flow rates and pressures of the liquid and air supplied to the nozzle or nozzles are closely monitored. They are then compared to calculated liquid and air-flow rates and pressures. In this way, the control system detects deviations of these flow rates based on a comparison of the measured or detected flow rater currently passed through the nozzle and a known or calculated flow rate for the nozzle being utilized. Thus, the performance of the nozzle or nozzles can be monitored. Other advantages and features of the invention will be apparent upon consideration of the following detailed description and claims.

DETAILED DESCRIPTION OF THE INVENTION

The present invention generally relates to a control system that monitors various operating parameters of a spray control system for gas conditioning applications. The control system monitors the flow rate of liquid and air passing through respective orifices of a spray nozzle. The system then processes the detected flows and compares the same to calculated flow rates. When the comparison exceeds a maximum error, the system provides a signal indicative of the characteristic and/or takes other appropriate action.

The invention has particular applicability to the industrial applications such as in the pulp and paper industry, waste recycling, steel fabrication, environmental control and power generation. Various specific spray applications within these general areas include lubrication showers, doctor showers, high pressure cleaning showers and screen or felt cleaning showers. The invention, however, may be used for other applications as well. The invention has particular applicability to the industrial applications such as in chemical production, cement, steel, pulp and paper, waste incineration and power generation. Various applications within these areas include gas cooling prior to introduction of the gases to a baghouse, nitrous oxide control systems such as in fossil fuel consumption and for diesel engines, and for sulfur dioxide removal in industrial wet or dry processes.

Figure 1:
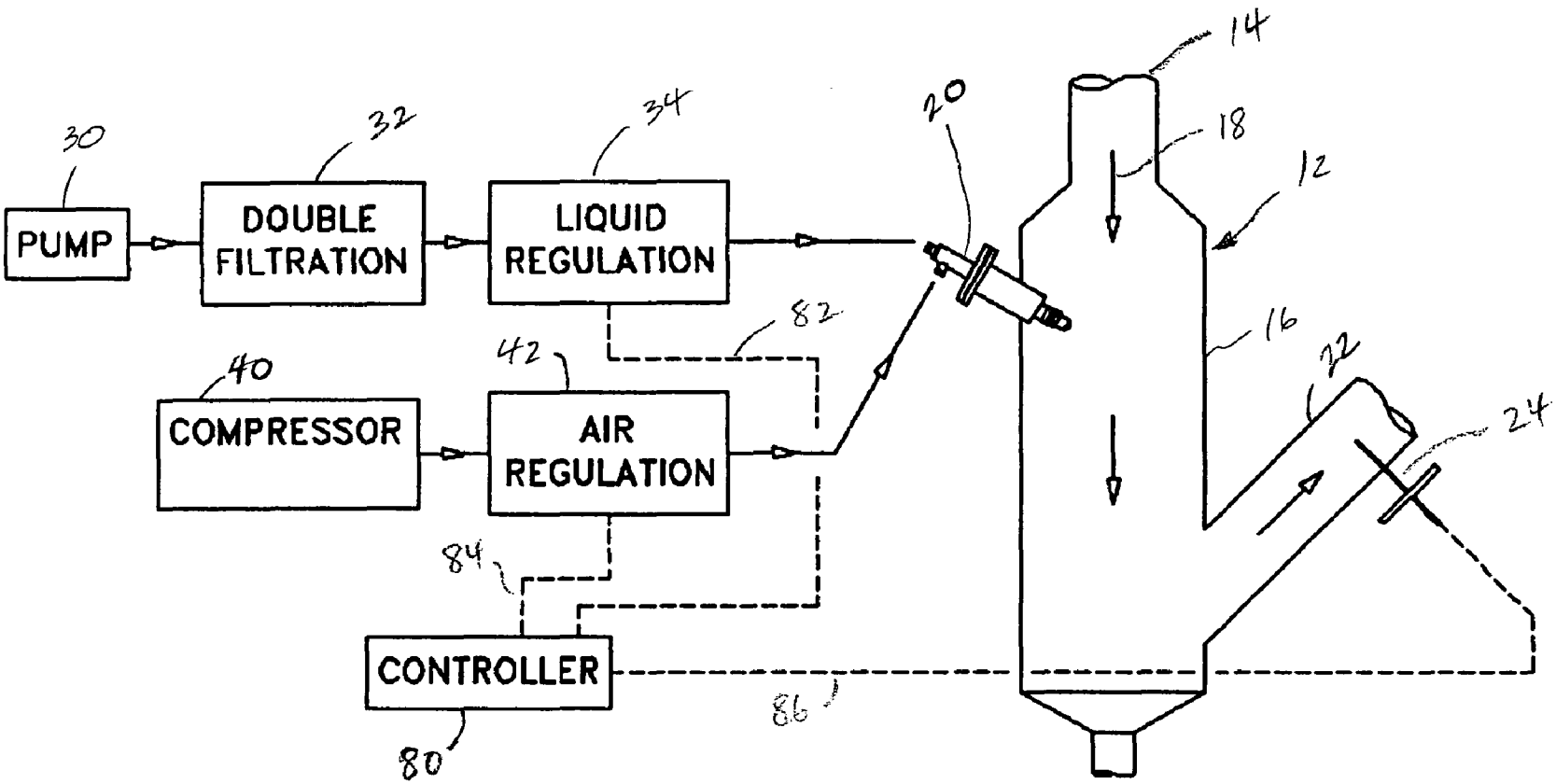
FIG. 1 is a schematic block diagram of an industrial plant and a spraying control system for monitoring the air pressure applied to a nozzle or nozzles according to the invention.

FIG. 1 illustrates one environment for implementing the present invention. As shown therein, an industrial plant 10 includes a gas conditioning system that comprise one or more conditioning towers such as conditioning tower 12 shown in FIG. 1. At its generally cylindrical inlet section 14, the conditioning tower 12 is disposed to receive hot flue gases created as part of the production process. The conditioning tower 12 includes a generally cylindrical mixing section 16, disposed downstream of the inlet section 14. The flue gases received at the inlet 14 are oriented in the general direction denoted by the arrow 18 shown in FIG. 1. One or more liquid spray nozzles such as nozzle 20 are disposed in at circumferential locations about the mixing portion 16 of the conditioning tower 12. In the illustrated embodiment, the liquid spray nozzle 18 is provided in the form of a lance and provides a liquid spray oriented in a generally downwardly directed liquid spray pattern for cooling the flue gases to a desired temperature.

The conditioning tower 12 also includes a cylindrical outlet or venting section 22. This section 22 is connected with the mixing portion 16 downstream of the spaced lances 20 and oriented at an angle with respect to the mixing portion 16. For measuring the temperature of the exiting flue gas stream, one or more temperature sensors 24 are disposed proximate the distal end of the outlet section 22. In most instances the liquid droplets have evaporated prior to reaching the outlet section 22 of the conditioning tower 12.

For providing liquid to the liquid spray nozzles 20, a liquid supply comprises a pump 30 coupled with a double filtration system 32. The filtration system 32 receives a pressurized liquid supply from the pump 30 and provides filtered liquid to a liquid regulation section 34. The regulation section 34 supplies a liquid at a desired pressure and a desired flow rate to the spray nozzles 20, as shown schematically in FIG. 1.

At the same time, a controlled air supply is also provided to the spray nozzles. As shown in FIG. 1, an air compressor 40 provides compressed air to an air regulation section 42. The air regulation section 42, in turn, supplies a regulated amount of compressed air to the spray nozzle 20. As discussed above, prior art systems provided a static amount of compressed air. This amount was applied regardless of the operating temperature of the exiting flue gases.

Figure 2:
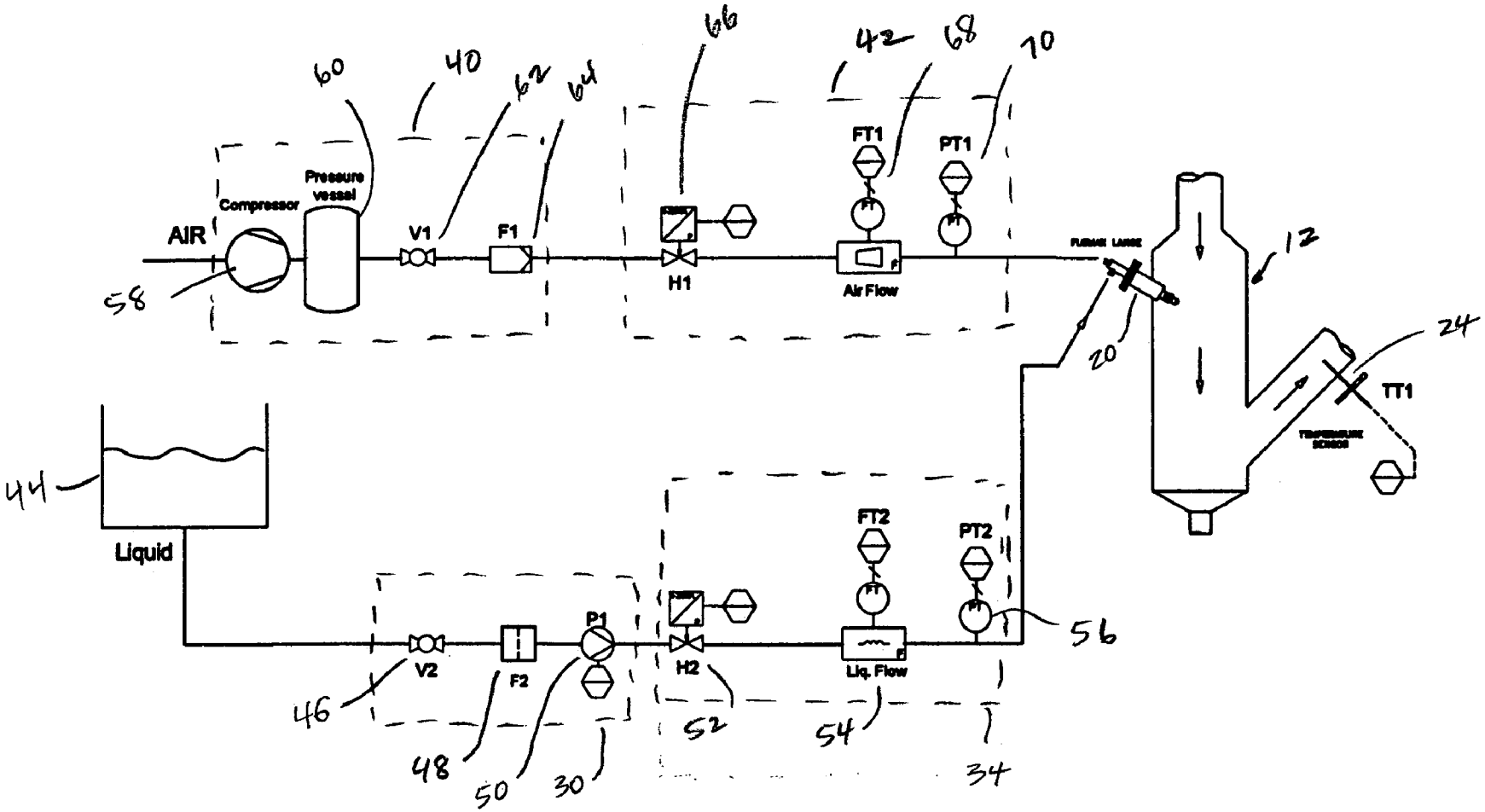
FIG. 2 is a more detailed block diagram representation of the spraying control system shown in FIG. 1.

FIG. 2 illustrates certain components of the liquid and air supply sections in one illustrated embodiment. As shown therein, a vessel 44 containing a liquid such as water supplies the liquid to the pump section 30 of the liquid supply. The pump section 30 may include an inlet valve 46. In the illustrated embodiment, the liquid passes through a liquid filter 48 to a pump 50. The pump operates to provide a pressurized liquid at its outlet.

From the pump section 30, a pressurized liquid is provided via a supply line to the liquid regulating section. In this instance, the pressurized liquid is supplied to a proportional regulating valve 52. The proportional regulating valve 52 controls the liquid supplied to the spray nozzle. The regulating valve, in turn, supplies the liquid to a liquid flow meter 54 for determining the flow rate of the liquid. A pressure sensor is also disposed in the liquid supply line, as part of the regulating section, for monitoring the pressure of the liquid supplied to the spray nozzles 20.

The details of the air supply section are also shown in FIG. 2. The air supply line includes a compressor 58 for providing compressed air to a pressure vessel 60. A flow control valve 62 is disposed at the outlet of the pressure vessel 60 for permitting compressed air to exit the vessel. An air filter 64 is preferable disposed in the air supply line for reducing impurities in the compressed air line.

FIG. 2 also shows the compressed air regulating section 42 in greater detail. As shown therein, a proportional regulating valve 66 regulates the compressed air supplied to the spray nozzle 20. In addition, an air flow meter 68 measures the consumption of the spray nozzle 20. Finally, a pressure meter 70 continuously monitors the pressure of compressed air supplied to the spray nozzle 20.

For controlling the liquid spray of the spray nozzles 20, a control system is coupled with a liquid regulation section and the compressed air regulation section. In the illustrated embodiment, a spray controller 80 performs various control functions by providing output control signals in response to the receipt of input control signals. Specifically, the controller 80 is disposed to receive a sensing signal from the temperature sensor 24, indicative of the temperature measured at the conditioning tower outlet 22. The controller 80 also receives input signals from the liquid section. These include a liquid flow signal from the liquid flow meter 54 indicative of the flow rate of the liquid applied to the spray nozzle. The controller 80 also receives a pressure-indicating signal from the pressure sensor 56.

In addition, the controller 80 receives various input signals from the compressed air line. Specifically, the controller 80 receives an air-flow rate signal from the air flow meter 68. Similarly, the controller 80 receives a sensing signal from the pressure sensor 70 associated with the air-flow line.

As explained in greater below, the controller 80 operates in a logical fashion to process these signals. The controller 80 then provides output signals to the liquid regulation section 34 as denoted by the line 82. This signal is applied to the proportional regulating valve 52 shown in FIG. 2 for controlling the liquid flow to the spray nozzle 20. In addition, the controller 80 provides an output signal to control the compressed air supply. That is, the controller 80 supplies a control signal to the proportional regulating valve 66 to control the amount of compressed air provided to the nozzle 20. Regulation of the liquid and air systems in this manner maintains the desired outlet temperature as well as the total evaporation of the liquid droplets. Moreover, monitoring the on-line performance of the spray nozzle in this fashion permits detection of wear and/or partial blockage of the spray nozzle. This permits avoidance of undue wetting of the filter system, increased air consumption, increased water consumption and/or insufficient cooling of the system.

In accordance with the invention, the control system determines the performance of one or more spray nozzles by monitoring various operating conditions of the nozzle. In one embodiment, the system compares a measured liquid flow rate with a calculated flow rate for the system at a certain operating pressure. In addition, the system compared a measure air flow rate with a calculated air flow rate for the system at a certain operating pressure. When the measured flow rates exceed a certain percentage deviation from the calculated flow rates, the system provides a sensing signal indicative of the deviation or initiates other appropriate action. In this way, the system determines the operating performance of the nozzles.

For monitoring the performance of the spray nozzle(s), the spray controller derives four variables: (1) $Q_L$: Total liquid flow rate delivered to the spray nozzle(s); (2) $P_L$: Liquid pressure delivered to the spray nozzle(s) (which in the preferred embodiment is the same inasmuch as the nozzles receive liquid via manifold supply); (3) $Q_A$: Total air flow rate delivered to the spray nozzle(s); and (4) $P_A$: Air pressure delivered to the spray nozzle(s) (which in the preferred embodiment is the same inasmuch as all of the nozzles receive air via a manifold supply).

In the illustrated embodiment, one nozzle 20 is shown. However, those skilled in the art will appreciate that a plurality of nozzles may be utilized. In this instance, the liquid pressure is typically the same for all nozzles since they depend from a common manifold liquid supply. On the other hand, where the nozzles originate from different manifolds or apparatus, the system determines multiple liquid flow rates at the various operating pressures.

For proper functioning spray nozzle(s), a known relationship between the above variables exists. That is, the liquid flow rate $Q_L$ and the air flow rate $Q_A$ are fixed at a given liquid pressure $P_L$ and an air pressure $P_A$ according to the following functions below:

$$Q_L=f_1(P_L, P_A)$$

$$Q_A=f_2(P_L, P_A)$$

The functions $f_1$ and $f_2$ are related to the type of nozzle being utilized. In the preferred embodiment, these functions are determined for a spray nozzle of a particular type by measuring the liquid and air-flow rates for different values of air and liquid pressure. In this fashion, these functions describe the proper performance behavior of a spray nozzle (or a plurality of nozzles) in the system.

In the nozzle control system 10 shown in FIGS. 1 and 2, the variables $Q_L$, $Q_A$, $P_L$ and $P_A$ are measured and are compared with theoretical or predetermined performance behavior characteristics. In particular, the control system uses the following declaration of variables:

$Q_{Lc}$: Total calculated liquid flow rate
$Q_{Ac}$: Total calculated air flow rate
$P_{Lm}$: Measured liquid pressure
$P_{Am}$: Measured air pressure
$Q_{Lm}$: Total measured liquid flow rate
$Q_{Am}$: Total measured air flow rate In addition, the calculated air and pressure flows are described as functions of measured liquid and air pressure, as set forth in Equations 3 and 4 below:

$$Q_{Lc}=f_1(P_{Lm}, P_{Am})$$

$$Q_{Ac}=f_2(P_{Lm}, P_{Am})$$

Based on the foregoing relationships, the system determines whether the nozzles are performing in a satisfactory or an unsatisfactory manner. In particular, the system determines the following relationships:

$$\frac{|Q_{Lc}-Q_{Lm}|}{Q_{Lc}} \geq \varepsilon \text{ or } \frac{|Q_{Ac}-Q_{Am}|}{Q_{Ac}} \geq \varepsilon$$

with $\epsilon$=maximum allowed percentage error.

In this way, the system determines that the operating nozzle or nozzles are not performing satisfactorily when the measured flow rate differs too much from the calculated flow rate at the given liquid pressure.

The relationship between the measured and calculated flow rates also provides an indication of performance problems. In a preferred embodiment, the system detects when the certain nozzle conditions are present based on the following relationships:

$Q_{Lm}>Q_{Lc}$: Liquid orifice(s) worn out

In this instance, the nozzle uses more liquid at given pressure conditions since the nozzle or nozzles in the system are worn.

$Q_{Lm}<Q_{Lc}$: Liquid orifice(s) partially blocked

On the other hand, this condition is indicative that the orifices for the nozzle are partially blocked because the nozzle uses less liquid at given pressure conditions.

In addition, the following conditions are also indicative of a performance problem:

$Q_{Am}>Q_{Ac}$: Air orifice worn out

In the above condition, the nozzle(s) utilize more air at given pressure conditions. This results in greater inefficiencies of the system when not corrected.

$Q_{Am}<Q_{Ac}$: Air orifice partially blocked

In this situation, the nozzle utilizes less air at given pressure conditions.

In accordance with one embodiment of the invention, a FloMax type FM1 nozzle, operating at 3.45 bar air pressure and 3 bar liquid pressure, may be utilized. In this embodiment, the nozzle theoretically uses 5 liters/minute liquid flow and 55 Nm3/hour air. When the spray controller 80 measures 6 liter/minute liquid flow at the given pressure conditions, a signal indicating that the nozzle is worn is supplied. Alternatively, when the spray controller measures 65 Nm3/hour air consumption at the same pressure conditions, then the spray controller 80 supplies a signal indicating that the air orifices are worn.

In practice, the invention may be implemented by reference to a look-up table maintained by the controller 50. This table preferably includes entries corresponding to various pressure/flow relationships and the calculated pressure and flow rate values. Thus, the system uses a table relationship for a for certain number of calibration points. These points are preferably within the normal working range of the nozzle or nozzles being employed. Thus, for a nozzle having a normal operating range from 1.0 bar to 5.0 bar liquid pressure, a table may include entries corresponding to a calculated liquid flow rate corresponding to 1.0, 2,0, 3.0, 4.0 and 5.0 bar liquid pressure. The controller 50 then uses interpolation based on the table entries to calculate the desired flow rate at a given liquid pressure. The calculated flow rate is compared with the measured flow rate as explained above, and appropriate corrective action is provided when the difference exceeds a particular value.

In keeping with the invention, the system may also alter various operating conditions to maintain proper operation of the system. For example, the system may also provide signals to chance the air pressure in accordance with changing gas cooling conditions. These may be the result of changing inlet gas temperature or of the flue gas flow rate. In this way, the system consumes only the required amount of air necessary for the given circumstances. The different possible process conditions are known by the system in advance. This information is used to calculate a table relation between required air pressure and liquid flow rate.

The amount of decrease in compressed air is dependent on the relationship of inlet temperature and flue gas flow rate. For example, when the inlet temperature remains constant, and only the actual gas flow rate reduces when the process operates at reduced conditions, then the gas velocity in the processing tower 12 is reduced. When the gas velocity is reduced, the liquid droplets have increased time to evaporate. If the inlet temperature remains constant, the droplet size of the liquid spray may be increased to obtain full evaporation over the same dwell distance. This results in substantially less compressed air consumption by the system.

For implementing the control system of the invention, several variations may be employed. For example, the control scheme may be made more reliable with the use of multiple pumps instead of a single pump 50. In addition, multiple filters may be employed rather than single liquid and air filters 48 and 64. In addition, safety bypasses can be added to guarantee a safety supply of liquid and air to the nozzle when sensors or regulating valves in the illustrated flow lines fail.

For implementing the invention, various control algorithms can be used. In accordance with one preferred embodiment, the control algorithms for controlling the regulating valves 52 and 66 are as follows:

The valve position of the proportional regulating valve 52 for the liquid supply is controlled in accordance with a PID control algorithm based on the measured outlet temperature by the temperature sensor 24 and the required set-point temperature. The set-point temperature is usually a constant value.

$$m = K_p \cdot \left(e + \frac{1}{K_i} \cdot \int e dt + K_d \cdot \frac{de}{dt}\right)$$

With m: the position of the valve of the regulating valve 52 (0 . . . 100%), e: the temperature difference between measured temperature and set point temperature, and Kp, Ki and Kd the proportional, integral and differential factors.

A PID control algorithm controls the valve position of the compressed air regulating valve 66. While various algorithms may be used, the input parameters are based on the measured air pressure by the pressure sensor 70 and the required air pressure set-point. The air pressure set-point itself is dependent on the current liquid flow rate as measured by the liquid flow meter 54.

The relationship between required air pressure and measured liquid flow rate depends on the process. In accordance with one embodiment of the invention, the required air pressure can be calculated based on the different gas inlet conditions. For implementing the invention, the required air pressure is calculated at various different inlet gas conditions. They are usually denoted by at least the following:

the minimum inlet gas conditions (which typically requires a minimum liquid flow rate);

the normal inlet gas conditions (which typically requires a normal liquid flow rate); and the maximum inlet gas conditions (which typically requires a maximum liquid flow rate).

The calculation of the air pressure depends on the required Dmax droplet size at the given conditions for having complete evaporation. As a result of these calculations, the controller 80 creates a table with three (or more) liquid flow rate values and their corresponding air pressure values. The control system uses this table for calculating the required air pressure (using interpolation between the table points).

In accordance with one preferred implementation of the invention, the following Table I is constructed in accordance with the various calculations employed by the control system:

TABLE I

| | Inlet Gas Flow Rate ($Nm^3$/hr) | Inlet Gas Temperature (° C.) | Required Dmax (μm) | Liquid Flow Rate (l/min) | Air Pressure (bar) |
|---|---|---|---|---|---|
| Minimum | 20000 | 280 | 120 | 12 | 2.5 |
| Normal | 25,000 | 300 | 110 | 19 | 3.5 |
| Maximum | 30,000 | 320 | 100 | 27 | 6.2 |

In this illustrative example, the controller 80 utilizes the shaded area in Table I above to calculate the desired air pressure that will be provided to the spray nozzle 20. In this way, the relationship between the liquid flow rate and the air pressure applied to the nozzle may be plotted in accordance with Table II below as follows:

TABLE II

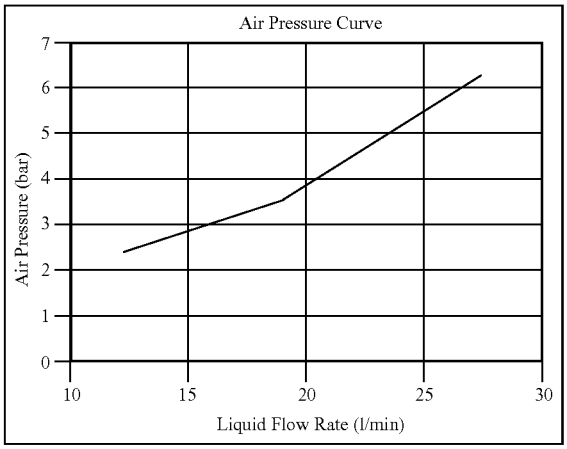

As shown, the worst-case operating condition with respect to required compressed air is located at the maximum liquid flow rate inasmuch as the maximum air pressure is required at this location. Thus, in prior art systems wherein the air pressure is maintained at a relatively constant value, the air pressure is required to be set to satisfy the worst-case condition. In the above-described example, the air pressure would be required to be maintained at approximately 6.2 bar.

In certain instances, the worst-case condition for compressed air requirements may be located at a diminished liquid flow rate, as shown in Table III below:

TABLE III

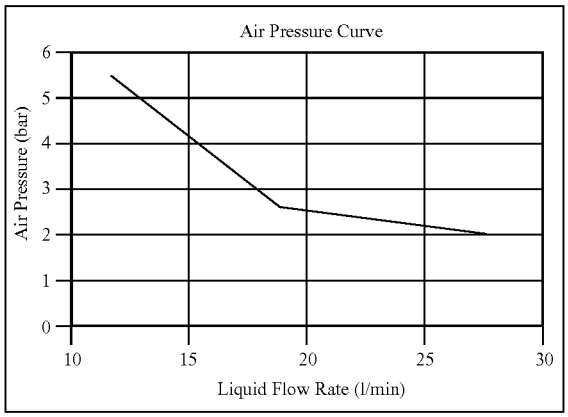

In this example, a substantial amount of compressed air that is applied to the system may be saved in comparison to prior art control systems that employed constant air pressure schemes. That is, as the liquid flow rate is increased, such as to a flow rate of 25 liters per minute, the required air pressure may be reduced to slightly more than 3 bar. On the other hand, when a diminished liquid flow rate is detected, such as approximately 12 liters per minute, the amount of compressed air may be increased, in this example to approximately 5.5 bar.

Accordingly, a control system for monitoring the amount of liquid and air passed through one or more spray nozzles that meets the aforestated objectives has been described. It should be understood, however, that the foregoing description has been limited to the presently contemplated best mode for practicing the invention. It will be apparent that various modifications may be made to the invention, and that some or all of the advantages of the invention may be obtained. Also, the invention is not intended to require each of the above-described features and aspects or combinations thereof, since in many instances, certain features and aspects are not essential for practicing other features and aspects. Accordingly, the invention should only be limited by the appended claims and equivalents thereof, which claims are intended to cover such other variations and modifications as come within the true spirit and scope of the invention.

What is claimed is:

1. A method for monitoring the operating conditions of one or more spray nozzles of the type used in the cooling of flue gases and that is operative to receive pressurized liquid and pressurized air and to supply an atomized liquid spray comprising the steps of:

determining a required pressure for various operating liquid flow rates being applied to the one or more spray nozzles;

monitoring an actual liquid flow rate being applied to the one or more spray nozzles;

monitoring a measured pressure of the liquid provided to the one or more spray nozzles determining a calculated liquid flow rate based on the measured pressure of the liquid;

comparing the actual liquid flow rate with the calculated liquid flow rate; and providing a signal indicative of a malfunction when a deviation between the actual liquid flow rate and the calculated liquid flow rate is greater than a maximum allowable percentage error.

2. A method as in claim 1 further comprising the step of:

monitoring an actual air flow rate being applied to the one or more spray nozzles;

monitoring a measured pressure of the pressurized air applied to the one or more spray nozzles;

determining a calculated air flow rate based on the measured pressure of pressurized air;

comparing the actual air flow rate with the calculated air flow rate; and providing a signal indicative of a malfunction when a deviation of the actual air flow rate from the calculated air flow rate is greater than a maximum allowable percentage error.

3. A control system for monitoring characteristics of one or more spray nozzles used in a flue gas cooling system wherein the one or more nozzles are of the type that operate to receive pressurized liquid and pressurized air and to provide an atomized liquid oriented at the flue gas to thereby cool the same, comprising:

a liquid supply line coupled with the one or more spray nozzles including a flow meter disposed therein for sensing a flow rate of liquid supplied to the one or more spray nozzles;

a compressed air supply line including an air regulation section disposed to provide an amount of compressed air supplied to the one or more spray nozzles; and a spray controller coupled with the flow meter and the air regulation section, the controller being disposed to provide an output signal to indicate a performance characteristic of the spray nozzles based on the measured liquid pressure and/or measured air pressure;

an adjustable liquid flow valve located in the liquid spray supply line disposed to receive a control signal from the controller to adjust the amount of liquid supplied to the one or more spray nozzles; and a temperature sensor located in proximate relation to the flue gas and disposed to provide a temperature sensing signal to the controller, wherein the controller in response to receipt of the temperature sensing signal, adjusts control signal supplied to the liquid flow valve, the controller being further programmed to perform acts of monitoring an actual liquid flow rate and an actual air flow rate being applied to the one or more spray nozzles during operation, determining a calculated liquid flow rate based on a measured liquid pressure and determining a calculated air flow rate based on a measured air pressure comparing the actual liquid flow rate with the calculated liquid flow rate and compare the actual air flow rate with the calculated air flow rate, and providing a signal indicative of a malfunction when either a deviation between the actual liquid flow rate and the calculated liquid flow rate is greater than a maximum allowable percentage error or a deviation of the actual air flow rate from the calculated air flow rate is greater than a maximum allowable percentage error.

4. A control system as in claim 3, wherein the controller is disposed to provide an output signal to indicate a worn nozzle when the actual liquid flow rate exceeds the calculated liquid flow rate by a selected threshold for given pressure conditions.

5. A control system as in claim 3, wherein the controller is disposed to provide an output signal to indicate a blocked liquid nozzle orifice when the actual liquid flow rate is less than the calculated liquid flow rate by a selected threshold for given pressure conditions.

6. A control system as in claim 3, wherein the controller is disposed to provide an output signal to indicate a worn air orifice when the actual air flow rate is greater than the calculated air flow rate by a selected threshold for given pressure conditions.

7. A control system as in claim 3, wherein the controller is disposed to provide an output signal to indicate a blocked air nozzle orifice when the actual air flow rate is less than the calculated air flow rate by a selected threshold for given pressure conditions.

* * * * *